United States Patent [19]

Bentrim et al.

[11] Patent Number: 4,893,535

[45] Date of Patent: Jan. 16, 1990

[54] SLOT-PUNCHING DEVICE

[76] Inventors: Glenn D. Bentrim, 7013 NW. 40th St.; Michael A. T. McKnight, 7006 NW. 40th St., both of Coral Springs, Fla. 33065

[21] Appl. No.: 243,497

[22] Filed: Sep. 12, 1988

[51] Int. Cl.[4] ..... B26F 1/18

[52] U.S. Cl. ..... 83/133; 83/139; 83/382; 83/564; 83/589; 83/599

[58] Field of Search ..... 83/564, 588, 589, 599, 83/383, 382, 133, 139, 585, 620

[56] References Cited

U.S. PATENT DOCUMENTS

| | | | |
|---|---|---|---|
| 914,613 | 3/1909 | Storlie . | |
| 1,294,033 | 2/1919 | Bizette . | |
| 2,379,003 | 6/1945 | Hedberg | 83/620 X |
| 2,449,108 | 9/1948 | Carlock | 83/588 X |
| 2,867,276 | 1/1959 | Taylor | 83/588 X |
| 3,308,699 | 3/1967 | Illingworth et al. | 83/133 |
| 3,362,271 | 1/1968 | Willis | 83/588 X |
| 3,408,889 | 11/1968 | Murphy | 83/599 |
| 3,520,220 | 7/1970 | Acker | 83/529 |
| 3,762,258 | 10/1973 | Bender | 83/588 X |
| 4,194,423 | 3/1980 | Cutler, Jr. | 83/589 |

*Primary Examiner*—Donald R. Schran

*Attorney, Agent, or Firm*—Oltman and Flynn

[57] ABSTRACT

A device for punching two parallel narrow slots in a sheet of paper at 45 degrees to one edge of the sheet and spaced apart slightly less than the corner-to-corner diagonal dimension of a card which is to be attached to that sheet by inserting diagonal corner segments into the slots. The slot-punching device has a generally flat base with an adjustable stop. A lever arm pivoted on the base carries two punches with respective narrow blades for reception in the base when the lever arm is lowered. A reciprocable head on top of the lever arm is depressed to push the punch blades down into the base when the lever arm is down.

8 Claims, 3 Drawing Sheets

FIG. 1
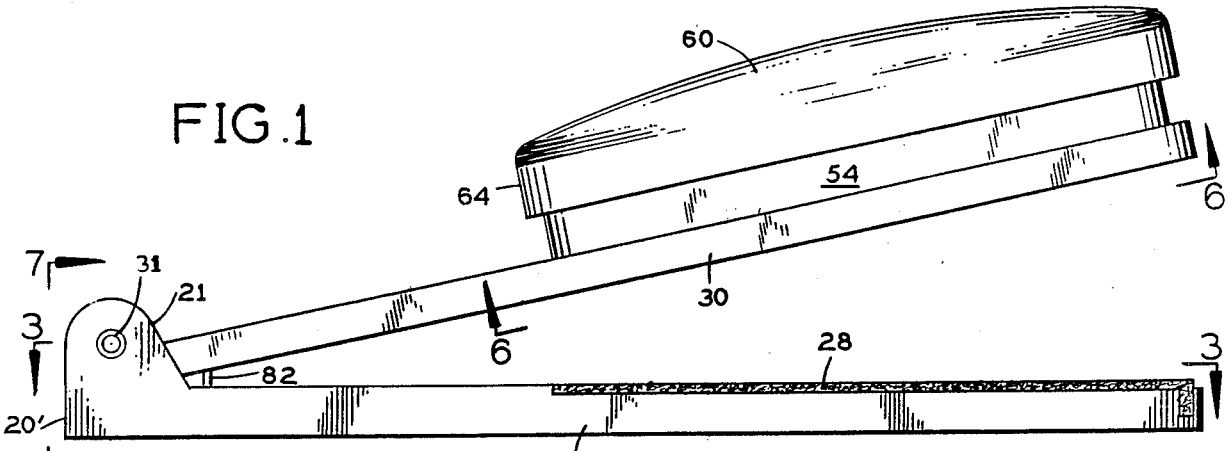
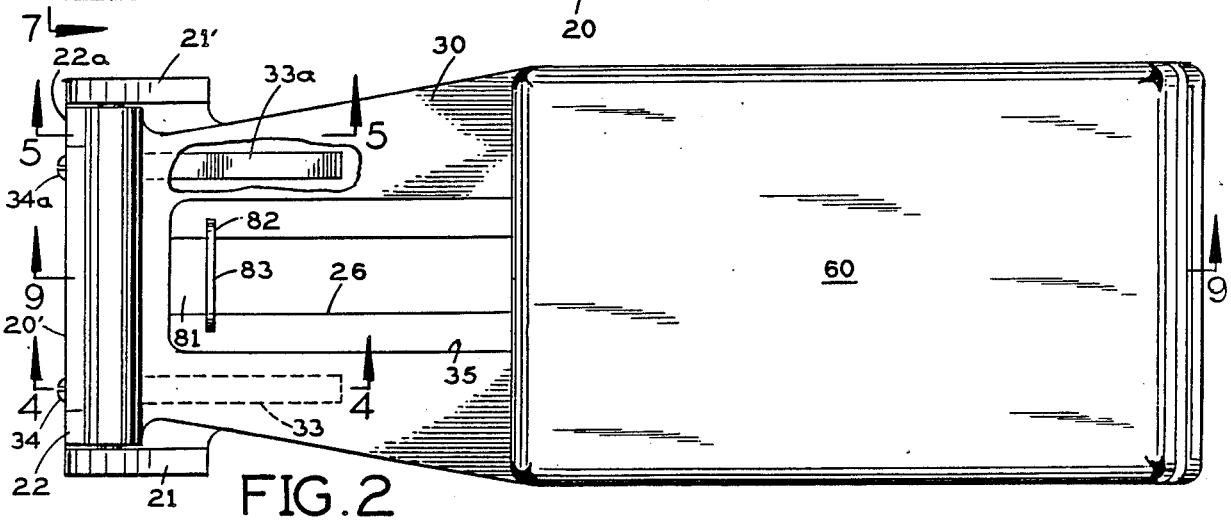
FIG. 2
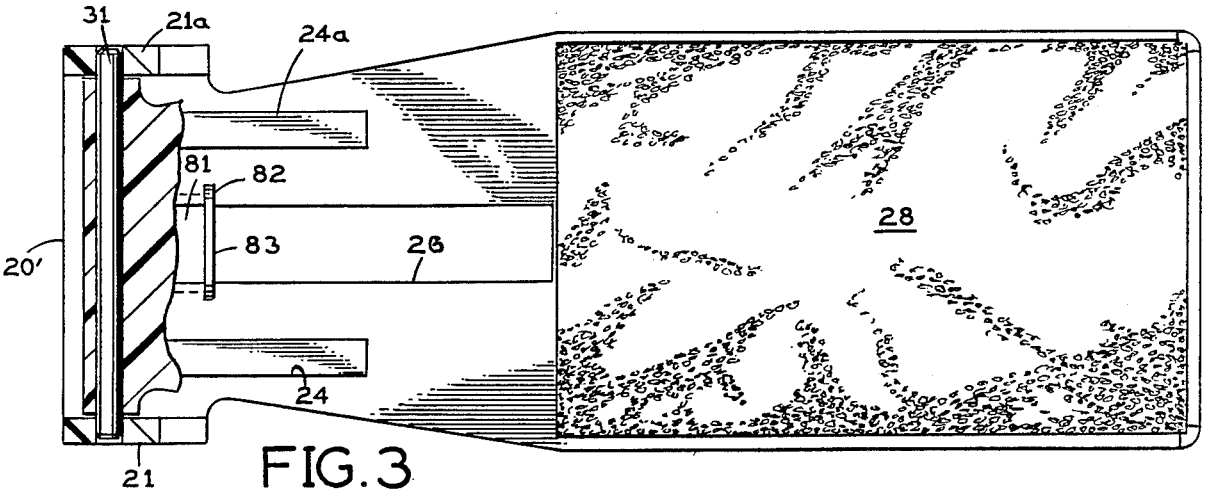
FIG. 3
FIG. 4
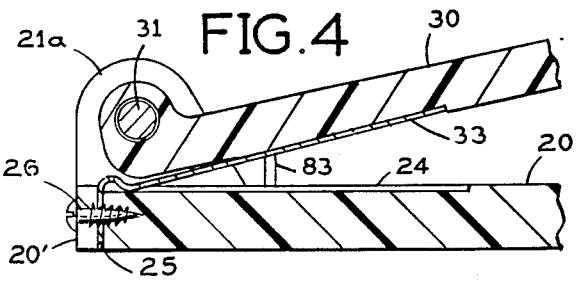
FIG. 5
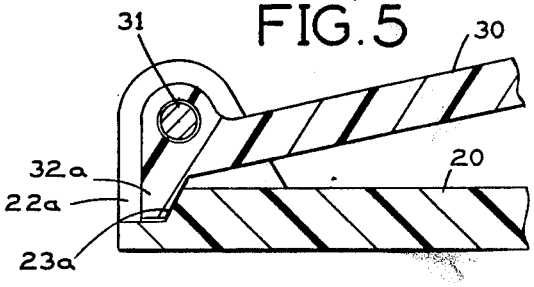

FIG. 14
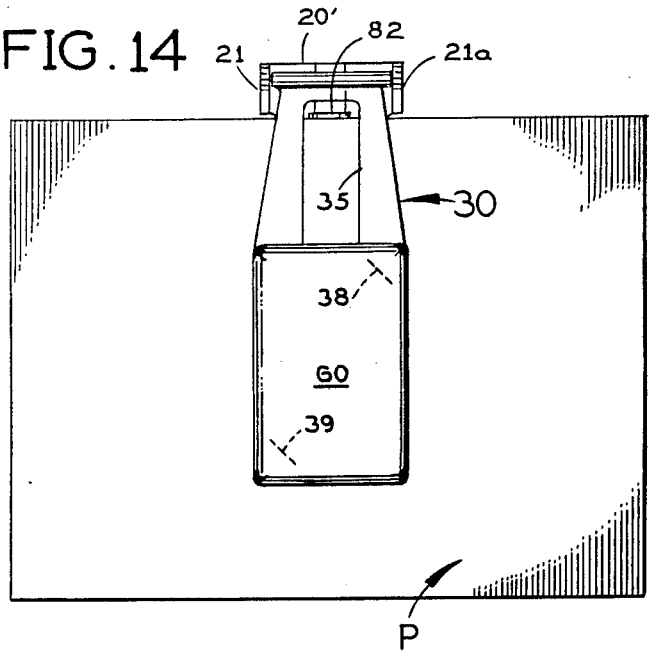
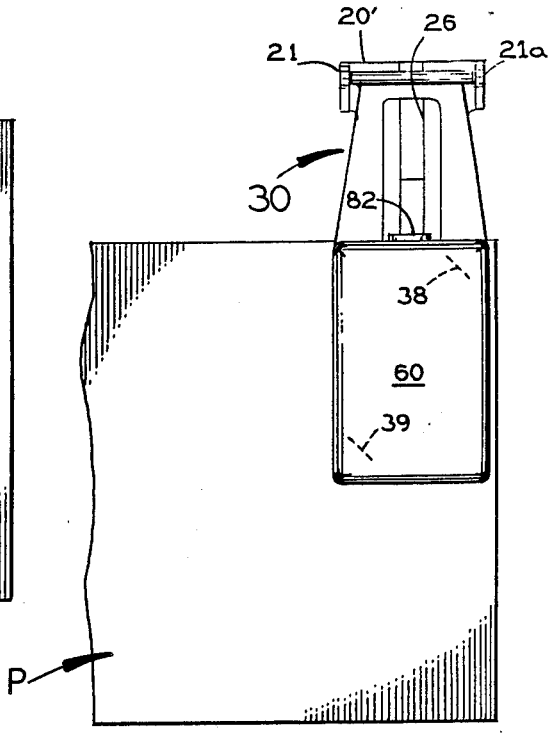
FIG. 15
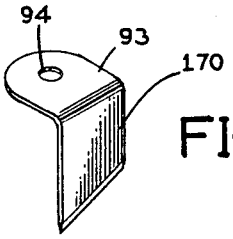
FIG. 18
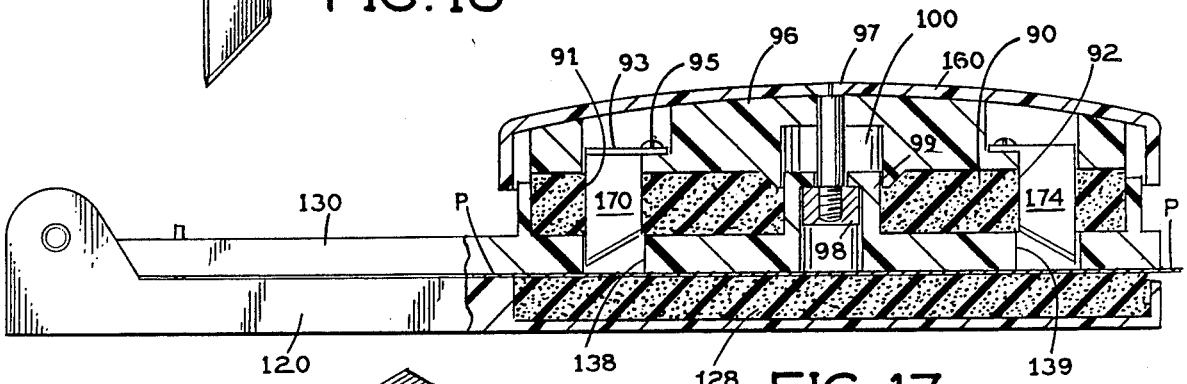
FIG. 17
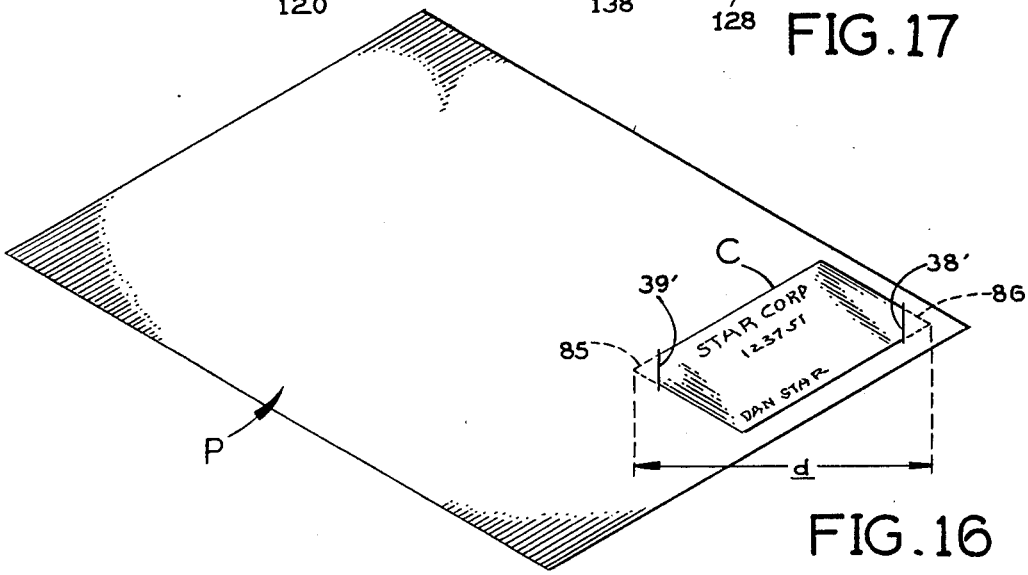
FIG. 16

SLOT-PUNCHING DEVICE

SUMMARY OF THE INVENTION

This invention relates to a device for punching narrow slots in a sheet of paper to hold diagonally opposite corner segments of a smaller card, such as a business card.

Situations occur in which a person may want to attach a small business card or the like to a larger sheet of paper without using staples or a paper clip. The present invention is directed to a novel device which solves this problem by making two narrow slots in a sheet of paper or the like such that a business card can be readily and easily attached to the sheet of paper by sliding diagonally opposite corners of the card through these slots and beneath the sheet of paper. The card is held in the slots securely enough that it is not likely to fall off the sheet accidentally but it can be deliberately removed manually without difficulty.

Preferably, in accordance with the present invention the slot-punching device comprises a generally flat base, a lever arm pivoted at one end to the base and spring-biased up from it, and a reciprocable head on top of the lever arm. A stop is adjustable longitudinally of the base and it presents a vertical surface above the base extending perpendicular to the longitudinal centerline of the base and engageable by one edge of the sheet of the paper. The base has a rubber insert on the top. The lever arm carries two sharp-bladed punches which penetrate this insert when the lever arm is pivoted down against the base. The punches are spring-biased to an upwardly retracted position on the lever arm. The reciprocable head on top of the lever arm can be pushed down to push the punches down into the insert in the base after the lever arm has been moved down on top of a sheet of paper overlying the base with one edge engaging the stop. The punches form narrow slots in the sheet of paper which are positioned to receive and hold diagonally opposite corner segments of a card smaller than the sheet of paper.

A principal object of this invention is to provide a novel device for punching two parallel slots diagonally in a sheet of paper or the like to hold a smaller card on the sheet.

Further objects and advantages of this invention will be apparent from the following detailed description of two presently preferred embodiments which are illustrated schematically in the accompanying drawings.

DESCRIPTION OF THE DRAWINGS

FIG. 1 is a side elevation of the present slot-punching device in its normal, unactuated condition with its pivoted lever arm raised from the base;

FIG. 2 is a top plan view of the device;

FIG. 3 is a horizontal section taken along the line 3—3 in FIG. 1, looking down on the base of the device;

FIG. 4 is a fragmentary longitudinal section taken along the line 4—4 in FIG. 2 at one of the springs which normally hold the lever arm raised from the base;

FIG. 5 is a similar view taken along the line 5—5 in FIG. 2 at one of the limit stops for the lever arm;

FIG. 14 is a top plan view showing the device positioned along a sheet of paper to punch slots for holding a card in the middle of the sheet;

FIG. 15 is a similar view showing the device positioned to punch slots for holding a card near one corner of the sheet of paper;

FIG. 16 is a perspective view of a sheet of paper which has been slotted by the present device and holds a card near one corner of the sheet.

FIG. 17 shows a second embodiment of the invention partly in side elevation and partly in longitudinal section; and FIG. 18 is a perspective view of one of the slotting punches in FIG. 17.

Figure 7:
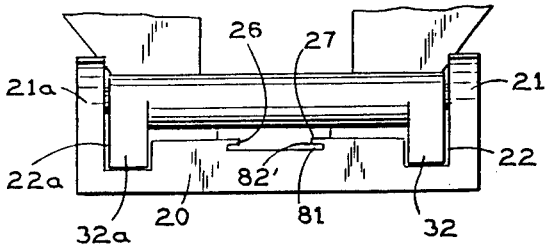
FIG. 7 is a view taken along the line 7—7 in FIG. 1 at the end of the device where the lever arm is pivoted to the base.

Before explaining the disclosed embodiments of the present invention in detail it is to be understood that the invention is not limited in its application to the details of the particular arrangements shown since the invention is capable of other embodiments. Also, the terminology used herein is for the purpose of description and not of limitation.

DETAILED DESCRIPTION

Referring to FIG. 1, in broad outline the presently preferred embodiment of this invention comprises a base 20 which is the first member of the punch, a second member of the punch in the form of a lever arm 30 pivoted on the base, and a reciprocable head 60 on the lever arm carrying punches for cutting narrow slots in a sheet of paper. As explained in detail hereinafter, the first and second members of the punch (base 20 and lever arm 30) are spring-biased apart to permit the insertion of a sheet of paper between them and may be manually actuated together to hold the sheet of paper between them for a punching operation.

The base 20 is a flat-bottomed plate having upstanding ears 21 and **21*a* (FIGS. 2 and 3) on its opposite sides at its back edge 20' (the left end in FIGS. 1-3). A pivot pin 31 for the lever arm 30** is supported by these ears.

Laterally inward from these ears the base has identical recesses 22 and **22*a* (FIG. 2) which are open at this end and at the top of the base. As shown in FIG. 5, recess 22*a* terminates at its front end in an upwardly and forwardly inclined surface 23*a* which serves as a stop for a downwardly extending ear 32*a* on the pivoted back end of lever arm 30. The other end recess 22 in the base has a similar stop surface at its inner end for engagement by a corresponding depending ear 32 (FIG. 7) on the back end of lever arm 30**.

Laterally inward from its end recesses 22 and **22*a*, the base has vertically shallow recesses 24 and 24*a* (FIG. 3**) in the top, each of which is of rectangular cross-section and is elongated lengthwise of the base. As shown in FIG. 4, recess 24 begins at a vertical slot 25 in the base located a short distance in front of its back edge 20'. A leaf spring 33, which engages the lever arm 30 from below, is anchored in slot 25 by a screw 34 and extends over recess 24 in the base. When the lever arm 30 is pushed down, the leaf spring 33 is partially received in the base recess 24. An identical leaf spring 33*a* (FIG. 2) engages beneath the lever arm over the shallow recess 24*a* (FIG. 3) in the base. Leaf spring 33*a* is fastened to the base by a screw 34*a* (FIG. 2) in the same manner as spring 33.

Figure 9:
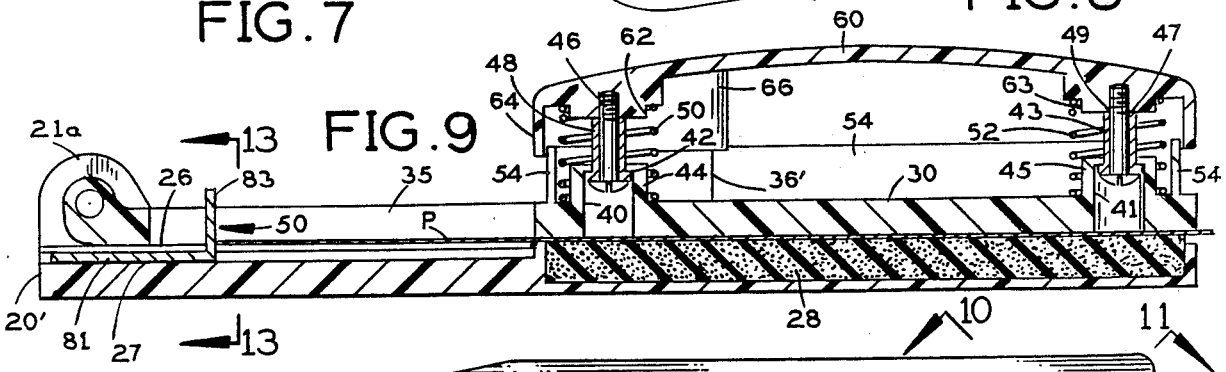
FIG. 9 is a longitudinal section taken along the longitudinal centerline of the device and showing the lever arm lowered to a closed position directly overlying the base and sandwiching between them a sheet of paper which is to be slotted.

Midway between its opposite sides the base has a groove of inverted, wide, T-shaped cross-section (FIGS. 7 and 13) which has an upper part 26, which is open along the top of the base, and a wider part 27 below, which extends on opposite sides of the upper part 26 so that it provides downwardly-facing shoulders on opposite sides of the upper part 26. This groove 26, 27 is open at the back edge 20' of the base, as shown in FIGS. 7 and 9, and extends longitudinally of the base for part of its length.

Figure 13:
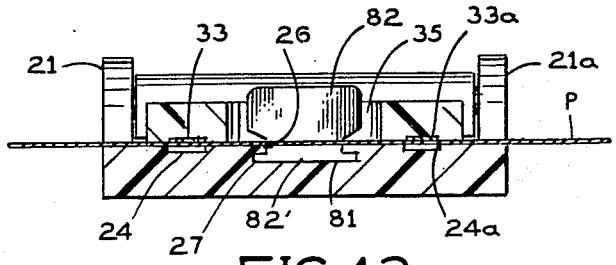
FIG. 13 is a vertical cross-section taken along the line 13—13 in FIG. 9.

A generally L-shaped stop member 80 is slidably adjustable along groove 26, 27 in the base. This stop member has an elongated flat bottom leg 81 of rectangular cross-section which is snugly but slidably received in the wider bottom part 27 of this groove, as shown in FIGS. 7, 9 and 13. A vertical leg 82 (FIG. 9) extends up from the bottom leg 81 at the back end of the stop member. As shown in FIGS. 7 and 13, this vertical leg has a narrow segment 82' at its lower end which passes snugly but slidably up through the narrower upper part 26 of the groove in the base and up past the top face of the base 20. The outer front face 83 of the vertical leg 82 of the stop member 80 provides a stop for engagement by an edge of a sheet of paper, as explained hereinafter. This face 83 lies in a vertical plane extending perpendicular to the longitudinal centerline of the base on opposite sides of that centerline.

The lever arm 30 has a longitudinal opening 35 (FIGS. 2 and 9) which passes the vertical leg 82 of stop member 80 in any position to which the stop member may be adjusted along the base groove 26, 27.

Figure 12:
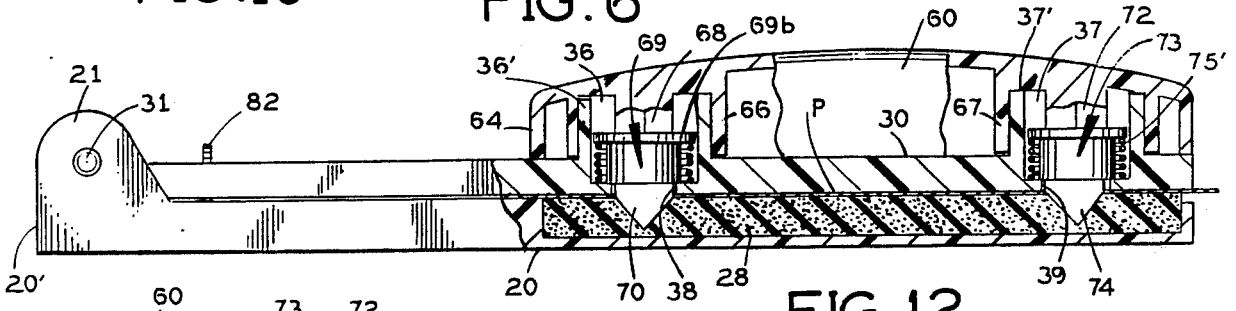
FIG. 12 is a view of the device, partly in side elevation and partly in section, showing its slotting punches forming slots in the sheet of paper.

Toward its front end (the end away from its back edge 20') the base 20 carries a hard rubber insert 28 which present an exposed flat top face. This rubber insert extends over about half the length of the base and is relatively thick vertically, as shown in FIG. 9 and 12.

The lever arm 30 has narrow rectangular openings 38 and 39 in the bottom (FIG. 6, 12, 10 and 11), each of which has its longer dimension extending at about 45 degrees laterally outward from the longitudinal centerline L of the lever arm. These openings are located completely on opposite sides of this centerline and they extend substantially parallel to one another. As shown in FIG. 12, the narrow opening 38 opens up into a larger cylindrical recess 36 which is open at the top of lever arm 30. The upper part of recess 36 is defined by a cylindrical boss 36' which projects up from the lever arm. The narrow opening 39 opens up into a larger cylindrical recess 37 which is open at the top of the lever arm. A cylindrical boss 37' on top of the lever arm defines the upper part of recess 37.

On its longitudinal centerline, the lever arm 30 has two cylindrical recesses 40 and 41 (FIGS. 6 and 9) which are open at the bottom of the lever arm. As shown in FIG. 9, these recesses extend up to smaller openings 42 and 43 in the top of cylindrical bosses 44 and 45 which project up from the lever arm.

A pair of threaded bolts 46 and 47 extend down from the reciprocable head 60 and have their respective heads slidably received in recesses 40 and 41. Respective flanged bushings 48 and 49 are engaged between the bottom of the reciprocable head 60 and the heads of these bolts. Bushing 48 is slidably received in the top opening 42 and recess 40 in the lever arm. Bushing 49 is slidably received in the top opening 43 and recess 41 in the lever arm.

A coil spring 50 at its lower end encircles the boss 44 on top of lever arm 30 and at its upper end encircles a cylindrical boss 62 on the bottom of reciprocable head 60. Similarly, a coil spring 51 at its lower end encircles the boss 45 on top of the lever arm and at its upper end encircles a cylindrical boss 63 that projects down from reciprocable head 60. Springs 50 and 51 are under compression and normally they bias the reciprocable head 60 up from the lever arm 30, as shown in FIG. 9, holding the flanges on bushings 48 and 49 up against the top of recesses 40 and 41, respectively. When the reciprocable head 60 is pushed down toward lever arm 30, the bushings 48 and 49 slide down along the respective recesses 40 and 41 and the top openings 42 and 43 to guide the movement of head 60 so that it remains substantially parallel to the lever arm while moving toward it.

As shown in FIGS. 1 and 9, the lever arm 30 has an upwardly projecting flange 54 at the top extending close to its opposite side edges and from side to side behind its rear boss 44 and in front of its front boss 45. The reciprocable head 60 has a downwardly extending flange 64 along its periphery which fits closely outside the lever arm flange 54. On the bottom near its back edge the reciprocable head 60 has a depending cylindrical boss 66 (FIGS. 9 and 12) which slidably encircles the boss 36' on top of lever arm 30. On the bottom near its front edge the reciprocable head 60 has a depending cylindrical boss 67 (FIGS. 10–12) which slidably encircles the boss 37' projecting up from the lever arm.

Figure 8:
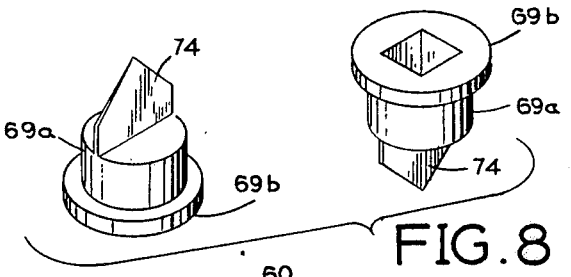
FIG. 8 is a composite of bottom and top perspective views of one of the slotting punches in the device.

As shown in FIG. 12, centrally inside its depending boss 66 the reciprocable head 60 has a downwardly-extending short stem 68 of rectangular cross-section which is snugly received in a complementary recess 69' (FIG. 8) in the top of a slotting punch 69. As best seen in FIG. 8, this punch has a generally cylindrical body 69*a* with a larger diameter, cylindrical, top flange 69*b* that is slidably received in recess 36 in the top of lever arm 30, as shown in FIG. 12. A narrow flat blade 70 with a sharp-pointed, sharp-edged, triangular lower end extends down from the body of the punch. A coil spring 71 is engaged under compression between the bottom of lever arm recess 36 and the bottom of punch flange 69*b* to hold the punch up against the stem 68 on the bottom of reciprocable head 60. The punch blade 70 projects down into the narrow bottom opening 38 in lever arm 30 with its pointed lower tip slightly above the bottom face of the lever arm.

Figure 10:
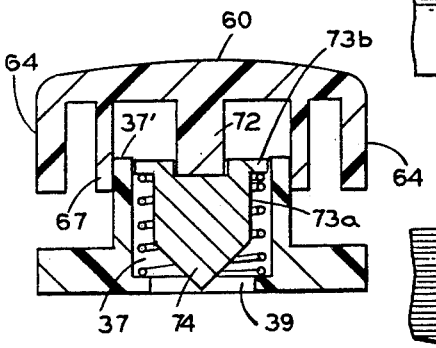
FIG. 10 is a cross-section taken along the line 10—10 in FIG. 6 at one of the slotting punches.
Figure 6:
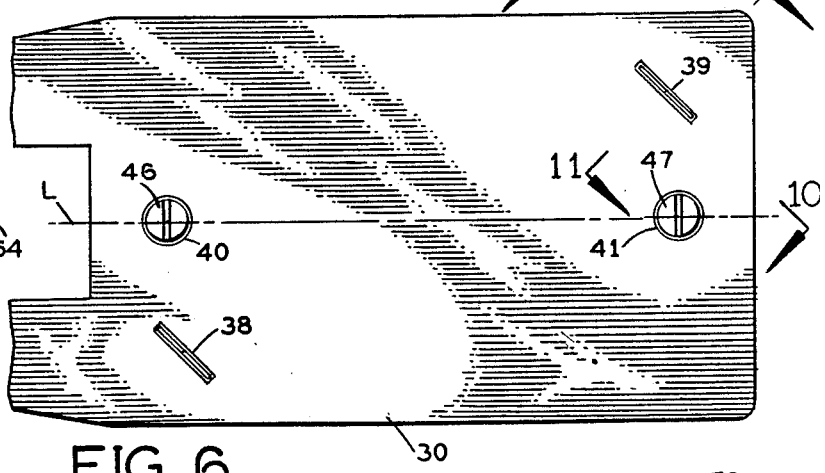
FIG. 6 is a partial bottom plan view of the lever arm taken along the line 6—6 in FIG. 1.
Figure 11:
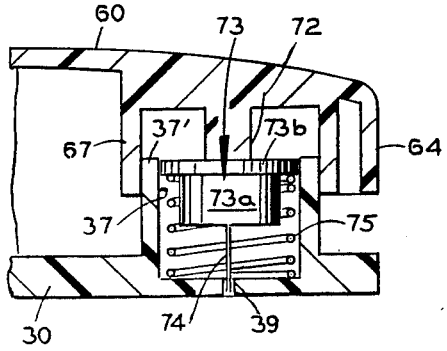
FIG. 11 is a cross-section taken along the line 11—11 in FIG. 6 at the same slotting punch.

Referring to FIGS. 10, 11 and 12, centrally inside its depending boss 67 the reciprocable head 60 has a downwardly-extending short stem 72 of rectangular cross-section which is snugly received in a complementary recess in the top of a slotting punch 73, which is identical to the one shown in FIG. 8. This punch has a cylindrical body 73*a* with a larger diameter cylindrical flange 73*b* at the top that is slidably received in recess 37 in the top of lever arm 30. A narrow blade 74 with a sharp-pointed, sharp-edged, triangular lower end extends down from punch body 73*a*. A coil spring 75 holds punch 73 seated against the lower end of stem 72. The punch blade 74 extends down into the narrow bottom opening 39 in lever arm 30 (FIG. 11) with the pointed lower end of the blade slightly above the bottom face of the lever arm.

Normally, springs 33 and 33*a* hold the lever arm 30 in its raised position, as shown in FIG. 1, with the depending ears 32 and 32*a* on the back end of the lever arm abutting against the stop surfaces at the inner ends of the recesses 22 and 22*a* in the back end of base 20 to limit the upward movement of the lever arm. Also, springs 50, 52, 70 and 75 hold the reciprocable head 60 up from lever arm 30.

Stop member 80 is positioned along the base 20 in accordance with where a card C (FIG. 16), such as a business card, is to be attached to an underlying rectangular sheet of paper P overlying the base 20 below the lever arm 30. One straight edge P′ of this sheet of paper engages the front face 83 of the vertical leg 82 of stop member 80. The two openings 38 and 39 in the lever arm of the present slotting device are spaced apart slightly less than the distance d between diagonally opposite corners 85 and 86 of the card C, so that triangular corner segments of the card will fit under the sheet P outside the slots 38′ and 39′ punched in the sheet at the openings 38 and 39 in the lever arm.

FIG. 14 shows the stop member positioned along the base 20 so that the card may be attached to the middle of a sheet of paper P having one of its longer edges P′ engaging the front face of the vertical leg 82 of stop member 80.

FIG. 15 shows the stop member positioned farther forward on the base (i.e., farther away from its back edge 20′) and engaging one long edge P′ of the sheet of paper P near a corner of the sheet. In this position of the stop member and the sheet of paper, the card C may be fastened to the sheet of paper near that corner, as shown in FIG. 16.

With stop member 80 adjusted to the desired position from back to front along the base 20, and with a sheet of paper P positioned with one edge against the front face 83 of the stop member's vertical leg 82, the user may push down on the reciprocable head 60 to pivot the lever arm 30 clockwise from the open or raised position, shown in FIG. 1, down to the closed or lowered position, shown in FIG. 9, in which the sheet of paper is sandwiched between the base 20 and the lever arm 30. After the lever arm 30 comes to a stop in its lowered position, continued downward pressure on the reciprocable head 60 pushes it down toward the lever arm and causes the punch blades 70 and 74 to move down in the lever arm openings 38 and 39 and pierce the sheet of paper where it overlies the rubber insert 28 on top of the base. The punch blades penetrate the rubber insert 28 when head 60 is pushed down completely.

When the head 60 is released, the springs 50, 52, 70 and 75 move it up on the lever arm 30 and strip the punch blades 70 and 74 from the rubber insert 28 on base 20 and from the slotted sheet of paper P, and springs 33 and 33 move the lever arm up from the base, permitting the sheet of paper to be removed.

FIG. 17 shows a second embodiment of the invention, like elements of which are given the same reference numerals plus 100 as those of the first embodiment.

In FIG. 17 the reciprocable head 160 carries a compressible and resilient pad 90 of sponge rubber or the like on the bottom overlying the lever arm 130. This pad has narrow openings 91 and 92 which slidably receive the depending, thin, flat blades 170 and 174 of respective punches shaped as shown in FIG. 18. Each punch blade is joined to a transverse top segment 93 which has an opening 94 for passing a screw 95 that attaches the punch to a rigid insert 96 in the reciprocable head 160.

Head 160 is slidably coupled to lever arm 130 by a bolt 97 extending down from the head and carrying a nut 98 on its lower end which is slidably received in a hollow projection 99 on the lever arm. Bolt 97 passes slidably through an opening in the top 100 of this projection.

The sponge rubber pad 90 acts as a spring which normally keeps the reciprocable head 160 in a raised position on lever arm 130, with the nut 98 engaging the top 100 of the hollow projection 99 on the lever arm, as shown in FIG. 17. This positions the punch blades 170 and 174 completely above the bottom face of the lever arm. After the lever arm 130 is pushed down against a sheet of paper P overlying the base 120, a continued downward push on the reciprocable head 160 compresses the sponge rubber pad 90 and forces the punch blades 170 and 174 down through the sheet of paper and into the rubber insert 128 on the base below.

When the head 160 is released, the pad 90 expands vertically and strips the punch blades from the base insert 128 and the sheet of paper P. The springs (corresponding to springs 33 and 33*a* in the first embodiment) which act between base 120 and lever arm 130 move the lever arm up from the base to permit removal of the slotted sheet of paper.

We claim:

1. A device for punching two narrow slots in a sheet with a straight edge to hold on the sheet a smaller card having a predetermined corner-to-corner diagonal dimension, said device comprising:

first and second members coupled to each other for movement toward and away from each other between an apart position permitting the insertion of the sheet between them and a together position holding said sheet between them;

a stop on one of said members having a flat surface for engagement by said straight edge of the sheet;

said second member having two punches with respective narrow, flat, substantially parallel punch blades theron which extend at a substantial acute angle to said flat surface of the stop and are offset from each other both parallel and perpendicular to said flat surface of said stop, said punch blades being spaced from each other slightly less than said corner-to-corner diagonal dimension of the card;

said first member having means for receiving said punch blades when said first and second members are in said together position;

each of said punches being slidably reciprocable in said second member between a first position away from said first member and a second position projecting from said second member into said first member;

said stop being slidably adjustable on said first member toward and away from said punch blades;

spring means on said second member biasing said punches to said first position;

and a reciprocable head on said second member for displacing said punches to said second position;

said spring means comprising:

a pair of coil springs engaged between said second member and said head to bias them apart;

and a pair of coil springs acting between said second member and said punches to hold said punches against said head.

2. A device for punching two narrow slots in a sheet with a straight edge to hold on the sheet a smaller card having a predetermined corner-to-corner diagonal dimension, said device comprising:

first and second members coupled to each other for movement toward and away from each other between an apart position permitting the insertion of the sheet between them and a together position holding said sheet between them;

a stop on one of said members having a flat surface for engagement by said straight edge of the sheet;

said second member having two punches with respective narrow, flat, substantially parallel punch blades thereon which extend at a substantial acute angle to said flat surface of the stop and are offset from each other both parallel and perpendicular to said flat surface of said stop, said punch blades being spaced from each other slightly less than said corner-to-corner diagonal dimension of the card;

said first member having means for receiving said punch blades when said first and second members are in said together position;

each of said punches being slidably reciprocable in said second member between a first position away from said first member and a second position projecting from said second member into said first member;

spring means on said second member biasing said punches to said first position;

and a reciprocable head on said second member for displacing said punches to said second position;

said spring means comprising:

a pair of coil springs engaged between said second member and said head to bias them apart;

and a pair of coil springs acting between said second member and said punches to hold said punches against said head.

3. A device for punching two narrow slots in a rectangular sheet of paper for holding a smaller rectangular card on said sheet at two diagonally opposite corners of the card, said device comprising:

a base having a longitudinal centerline and a substantially flat top face;

an upper member above said base having a longitudinal centerline which registers with the longitudinal centerline of the base, said upper member having a first narrow opening on the bottom spaced from said centerline of said upper member on one side thereof and elongated at an angle of substantially 45 degrees to said centerline of said upper member, said upper member having a second narrow opening on the bottom spaced from said first opening lengthwise of said upper member, said second opening being spaced from said centerline of said upper member on the opposite side thereof and being elongated substantially parallel to the direction of elongation of said first opening, said openings being spaced apart slightly less than the distance between said diagonally opposite corners of the card;

a stop member slidably adjustable on the base along said centerline of base, said stop member presenting a flat vertical surface above said base extending perpendicular to said centerline of the base on opposite sides of said centerline of the base;

said upper member being coupled to said base for movement down toward said base and up away from said base, said upper member when positioned up away from said base permitting a sheet of paper to be inserted on top of the base with one of its edges against said flat surface of the stop member;

and first and second punches on said upper member, said first punch having a sharp-edged blade which is reciprocable up and down in said first opening in the upper member, said second punch having a sharp-edged blade which is reciprocable up and down in said second opening in the upper member.

4. A device according to claim 3 wherein said upper member is a lever arm pivotally supported on said base.

5. A device according to claim 4 wherein:

each of said punch blades is slidably reciprocable up and down in said lever arm between a raised position in which it is above the bottom of the lever arm and a lowered position in which it projects down below the bottom of the lever arm; and further comprising:

spring means biasing said punches to said raised position;

and a head reciprocably mounted on top of said lever arm for movement up and down with respect to the lever arm, said head being coupled to said punches to move said punch blades down to said lowered position when the head is pushed down on the lever arm.

6. A device according to claim 5 wherein said means for receiving said punch blades is rubber-like material on said first member.

7. A device according to claim 5 wherein said spring means comprises:

a pair of coil springs engaged between said lever arm and said head to bias them apart;

and a pair of coil springs acting between said lever arm and said punches to hold said punches against said head.

8. A device according to claim 5 wherein: said punches are fastened to said head;

and said spring means is a resilient and compressible pad on said lever arm engaging said reciprocable head.

* * * * *